US010448677B2

(12) United States Patent
Pena

(10) Patent No.: US 10,448,677 B2
(45) Date of Patent: Oct. 22, 2019

(54) RETRACTABLE POCKET SQUARE AND HOLDER APPARATUS AND METHOD OF USE

(71) Applicant: Jorge L. Pena, Jersey City, NJ (US)

(72) Inventor: Jorge L. Pena, Jersey City, NJ (US)

( * ) Notice: Subject to any disclaimer, the term of this patent is extended or adjusted under 35 U.S.C. 154(b) by 182 days.

(21) Appl. No.: 15/720,794

(22) Filed: Sep. 29, 2017

(65) Prior Publication Data

US 2019/0098939 A1 Apr. 4, 2019

(51) Int. Cl.

| | |
|---|---|
| ***A41D 27/20*** | (2006.01) |
| ***A41B 15/00*** | (2006.01) |
| ***A41B 15/02*** | (2006.01) |
| ***A45F 5/02*** | (2006.01) |
| ***A45F 5/04*** | (2006.01) |

(52) U.S. Cl.

CPC ..... *A41B 15/02* (2013.01); *A41B 15/00* (2013.01); *A45F 5/022* (2013.01); *A45F 5/04* (2013.01)

(58) Field of Classification Search

CPC ..... A41B 15/00; A41B 15/02; A41D 27/201; A41D 27/204; A41D 27/20; A45F 5/04; A45F 5/022

USPC ..... 2/244, 249, 251, 279

See application file for complete search history.

(56) References Cited

U.S. PATENT DOCUMENTS

| | | | | |
|---|---|---|---|---|
| 2,060,729 | A * | 11/1936 | Gilgenbach | A41B 15/02 2/279 |
| 6,412,118 | B1 * | 7/2002 | Shanklin | A41B 15/02 2/279 |
| 7,854,021 | B2 * | 12/2010 | Compton | G09F 21/02 2/243.1 |
| 9,051,681 | B1 * | 6/2015 | Costa | D06F 89/02 |
| 9,516,903 | B1 * | 12/2016 | Gambuzza | A41B 15/02 |
| 9,596,889 | B1 * | 3/2017 | Gambuzza | A41B 15/02 |
| 2007/0113323 | A1 * | 5/2007 | Groves | A41B 15/02 2/279 |
| 2008/0172772 | A1 * | 7/2008 | Kim | A41D 25/005 2/144 |
| 2014/0352034 | A1 * | 12/2014 | Bhiro | A41B 15/02 2/279 |
| 2015/0296904 | A1 * | 10/2015 | Darmetko | A41D 20/00 2/170 |
| 2016/0120234 | A1 * | 5/2016 | Cobb | A41B 15/02 2/250 |

* cited by examiner

*Primary Examiner* — Jameson D Collier

(74) *Attorney, Agent, or Firm* — Law Office of Mark Brown, LLC; Christopher M. DeBacker

(57) ABSTRACT

A pocket square enclosure for securing a pocket square, thereby preventing the pocket square from moving or unfolding. A back enclosure secures the pocket square enclosure to the suit pocket, thereby incorporating the enclosure itself into the fashion of the pocket square. In an embodiment, the pocket square could be flippable, where a first pocket square pattern, color, or design faces one direction from the enclosure, and a second pocket square pattern, color, or design face the other for fast, on-the-fly adjustment to the user's fashion accessory. Other designs could include spikes or other design elements added to the pocket square.

10 Claims, 8 Drawing Sheets

RETRACTABLE POCKET SQUARE AND HOLDER APPARATUS AND METHOD OF USE

BACKGROUND OF THE INVENTION

1. Field of the Invention

The present invention relates generally to a pocket square system and method for use thereof, and more specifically to a pocket square enclosure for receiving a stylized pocket square.

2. Description of the Related Art

Traditional pocket squares used as an accessory with a suit jacket or blazer require careful folding and placement into the pocket, and often become dislodged or unfolded over time, looking sloppy. Further, the traditional pocket square is an older accessory which could use modern updates to go with modern fashions.

Heretofore there has not been available a system or method for a pocket square system with the advantages and features of the present invention.

BRIEF SUMMARY OF THE INVENTION

The present invention generally provides a pocket square enclosure for securing a pocket square, thereby preventing the pocket square from moving or unfolding. A back enclosure secures the pocket square enclosure to the suit pocket, thereby incorporating the enclosure itself into the fashion of the pocket square. In an embodiment, the pocket square could be flippable, where a first pocket square pattern, color, or design faces one direction from the enclosure, and a second pocket square pattern, color, or design face the other for fast, on-the-fly adjustment to the user's fashion accessory. Other designs could include spikes or other design elements added to the pocket square.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Pocket Square System 2

Figure 7:
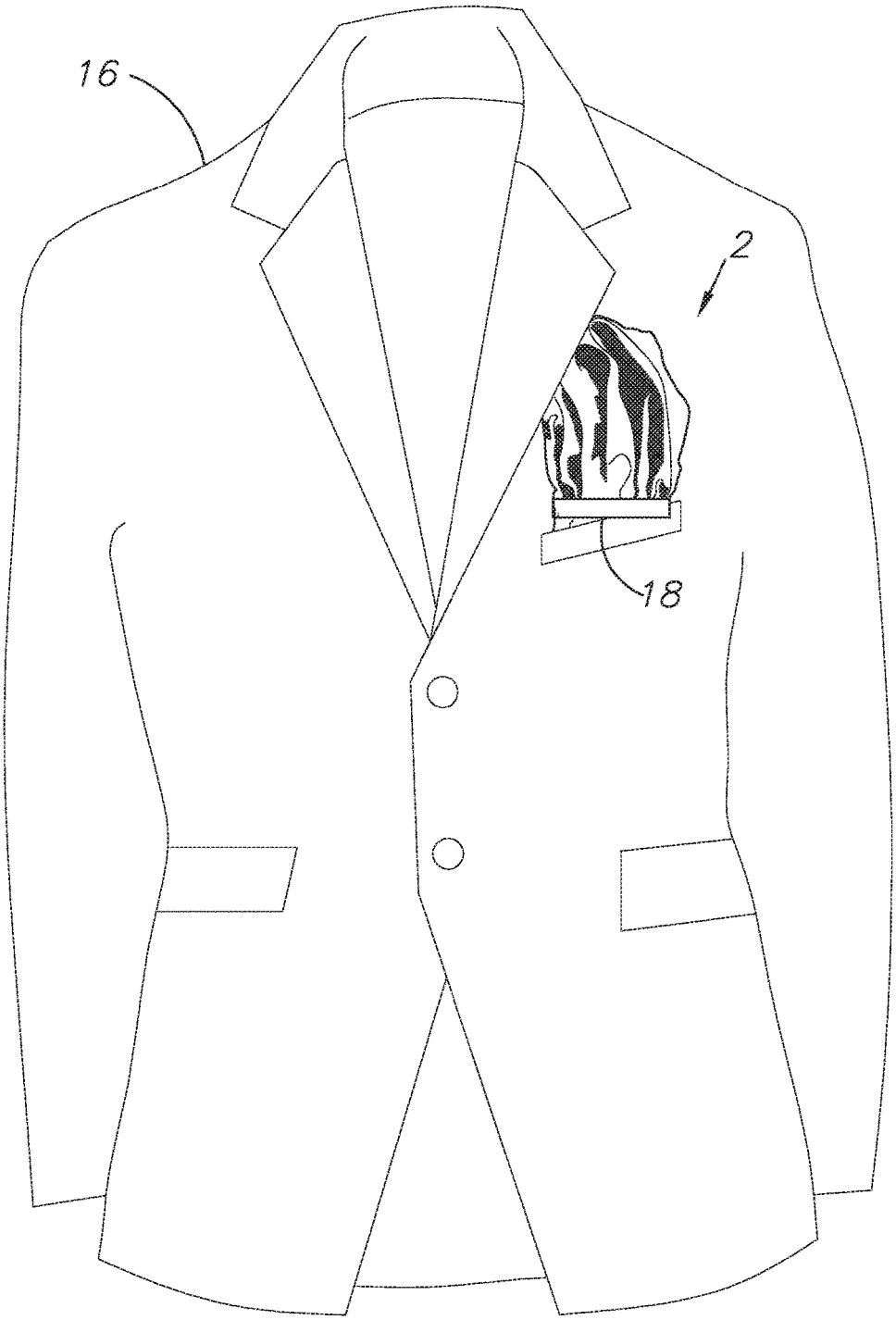
FIG. 7 is a front elevational view of the embodiment of FIG. 1 shown in a typical environment worn in a suit jacket pocket.
Figure 8:
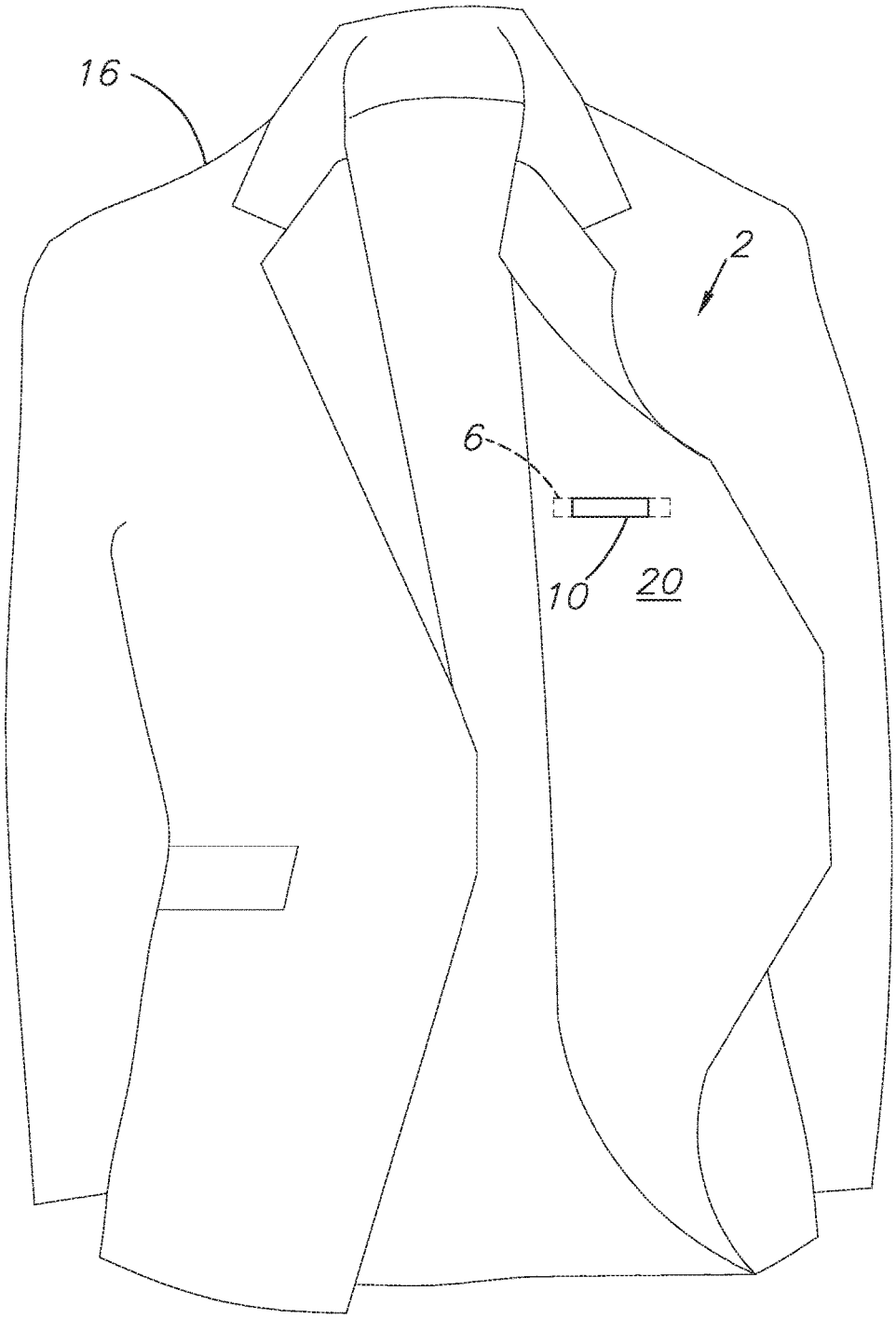
FIG. 8 is a front elevational view thereof, showing the suit jacket in an open configuration.

As shown in FIGS. 1-3 and 7, the pocket square system 2 incorporates a pocket square 4 made of a cloth material and an enclosure 6 which receives the pocket square and prevents it from unfolding or moving. The enclosure 6 may include designs or text 8 for additional fashionable flair. A backing plate 10 connects to the back face of the enclosure 6 via a pair of magnets 12. A slip gap 14 in the enclosure 6 allows the pocket square to be easily slid into the enclosure while folded. The backing plate 10 would be inserted into the pocket 18 or behind the pocket on the lining 20 of a jacket 16, thereby securing the enclosure 6 to the front of the pocket 18, with the pocket square 4 and designs or text 8 in full view as shown in FIG. 7.

In the preferred embodiment, the pocket square 4 itself would be a pre-folded piece of fabric, such as silk around an internal mesh material, which is already in a preferred and pre-folded form. However, the present invention would work with all shapes and sizes of pre-folded pocket squares, as well as typical, unfolded pocket squares which are folded by the user and placed into the enclosure 6.

Figure 1:
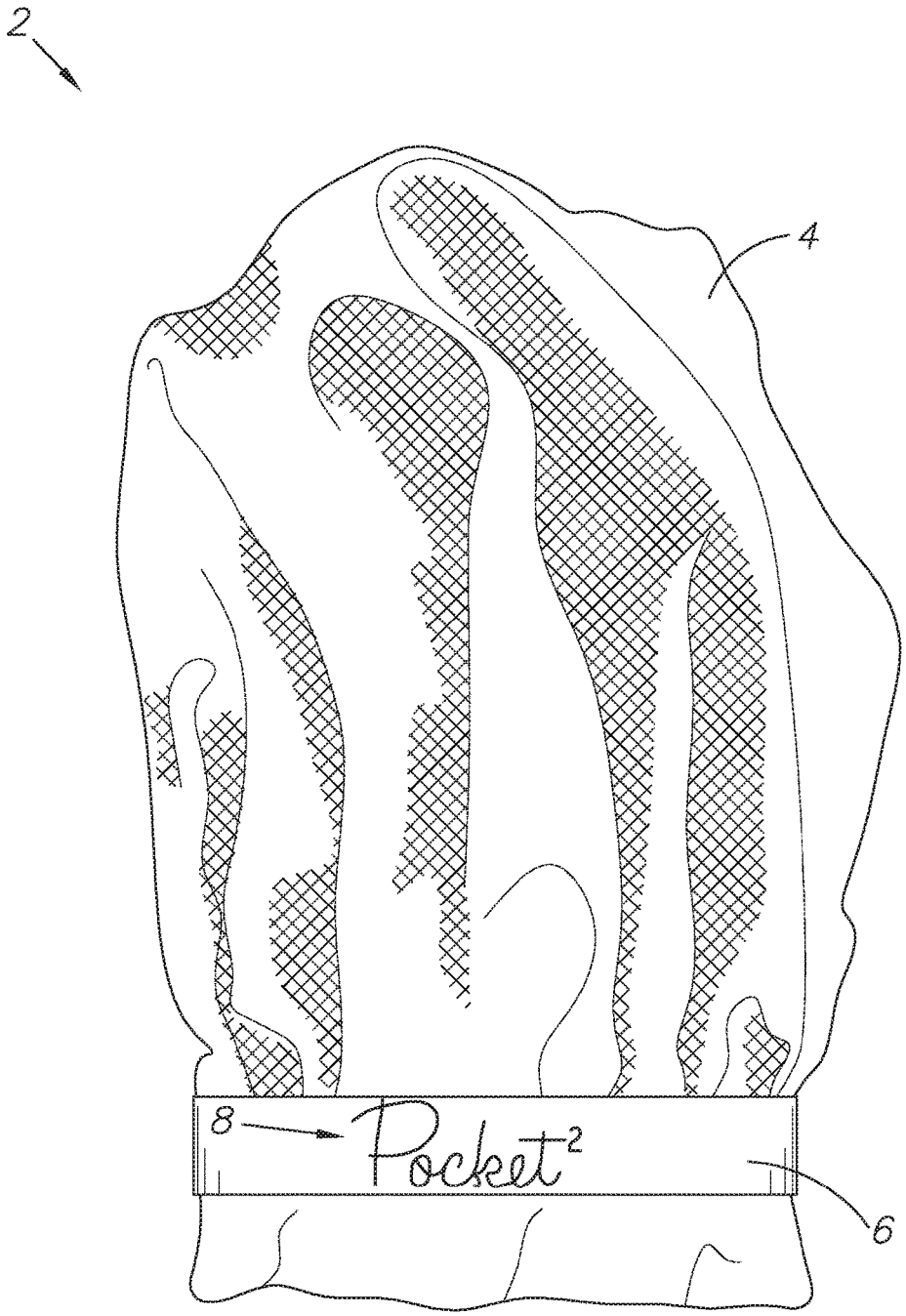
FIG. 1 is a front elevational view of a preferred embodiment of the present invention.
Figure 2:
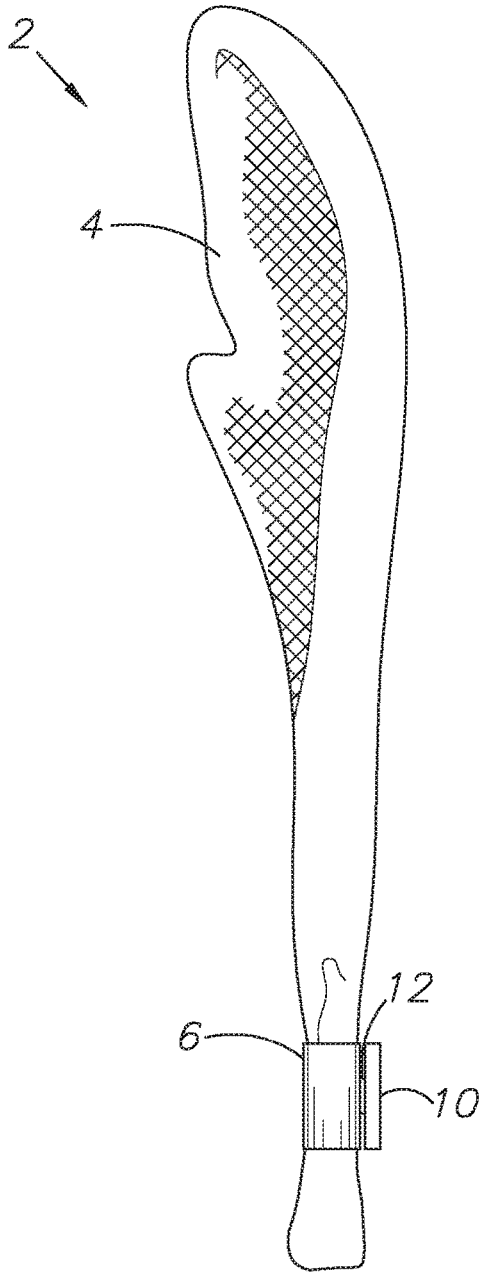
FIG. 2 is a right side elevational view thereof.
Figure 3:
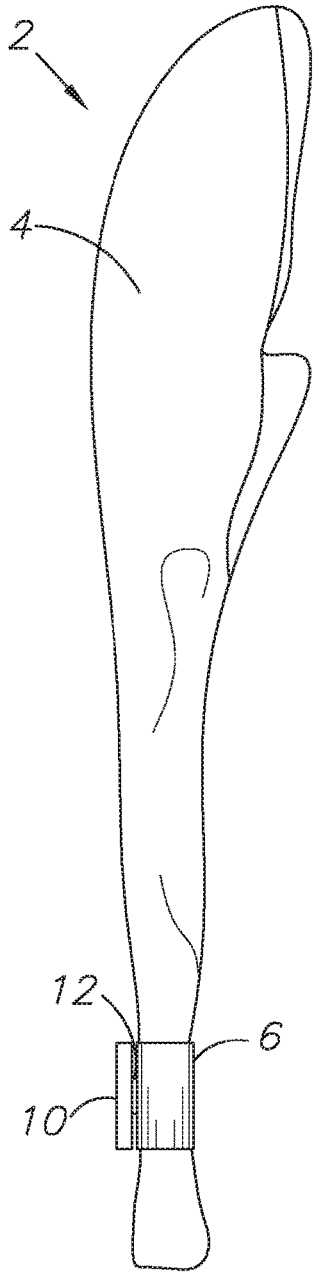
FIG. 3 is a left side elevational view thereof.
Figure 4:
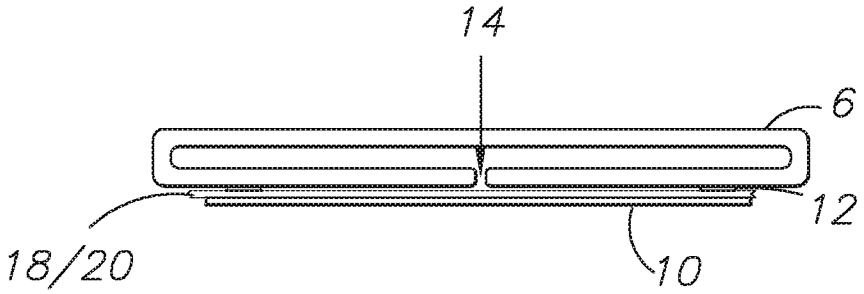
FIG. 4 is a top plan view of a enclosure element of the embodiment of FIG. 1.
Figure 5:
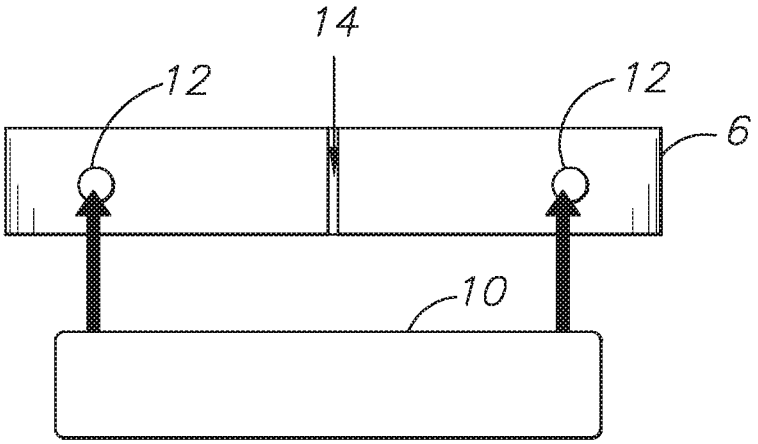
FIG. 5 is a back elevational view of the enclosure element thereof, showing the connection of a backing plate.
Figure 6:
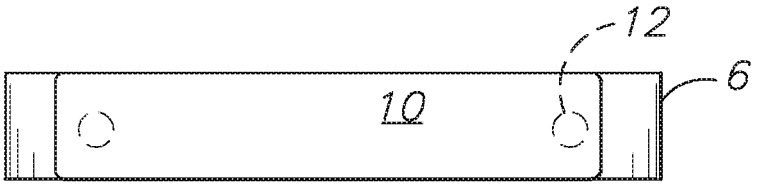
FIG. 6 is a back elevational view thereof, wherein the backing plate is attached to the enclosure.
Figure 9:
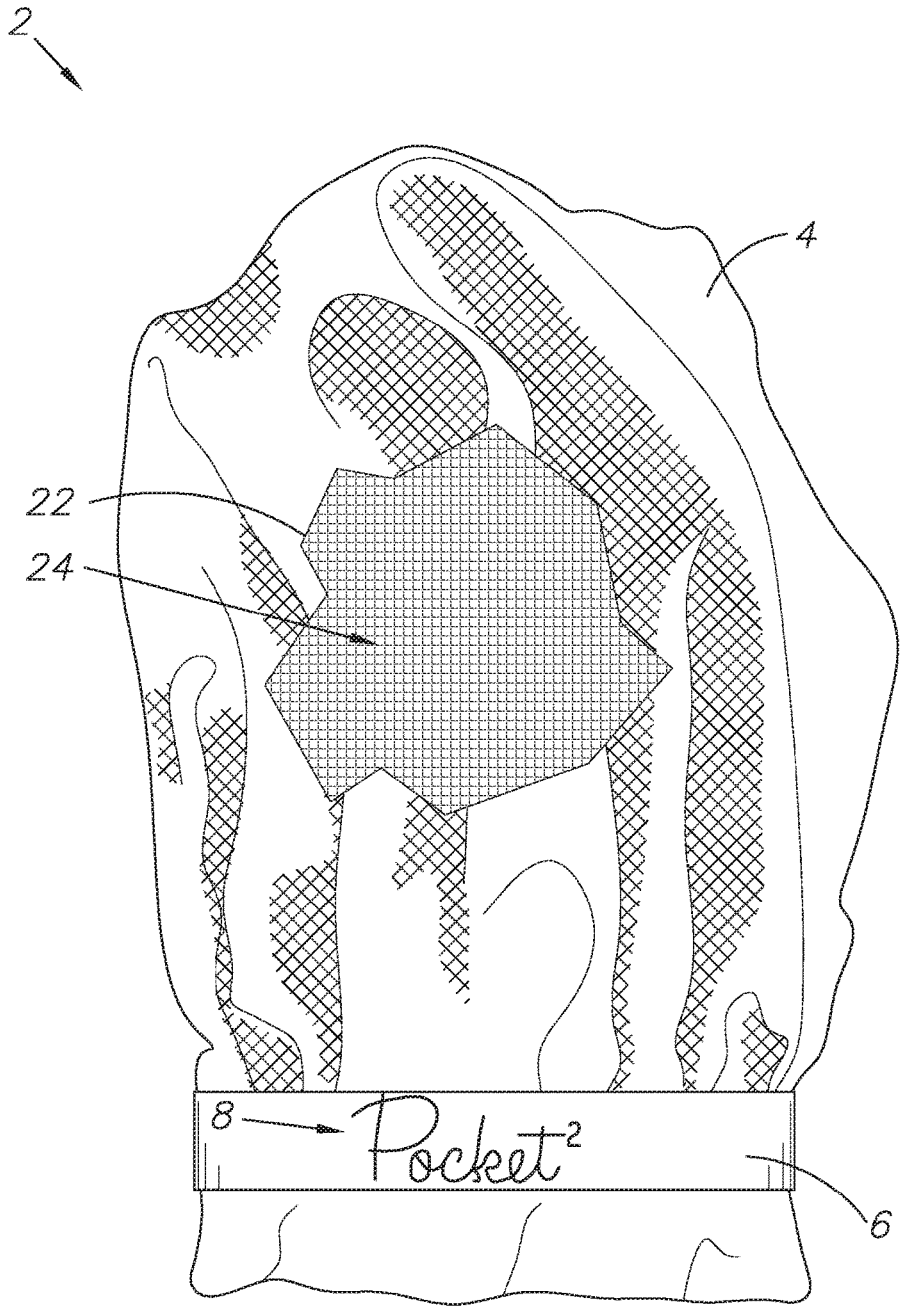
FIG. 9 is an identical view of FIG. 1 showing a cut-out portion and a mesh component below an outer material component.

FIGS. 4-6 show in more detail how the backing plate 10 connects to the enclosure 6 via the magnets 12. As shown in FIG. 4, this can allow the backing plate 10 to be inserted behind the pocket 18 and/or lining 20 of the jacket 16, such that the pocket cloth is between the backing plate 10 and the back face of the enclosure 6. The magnets 12 provide secure connection through the pocket 18. A further purpose of the backing plate 10 is to close off the slip gap 14. FIG. 9 shows more clearly how the backing plate could be inserted behind the enclosure into the lining.

The backing plate 10 could connect to the enclosure 6 in multiple ways, including using snaps, pins, buttons, adhesives, or other suitable connection types. Further, the backing plate is not entirely necessary if pins, tape, snaps, or other connection types are incorporated into the enclosure itself. However, the preferred embodiment uses the magnets 12 and backing plate 10 for the most secure and professional looking final result.

Figure 10:
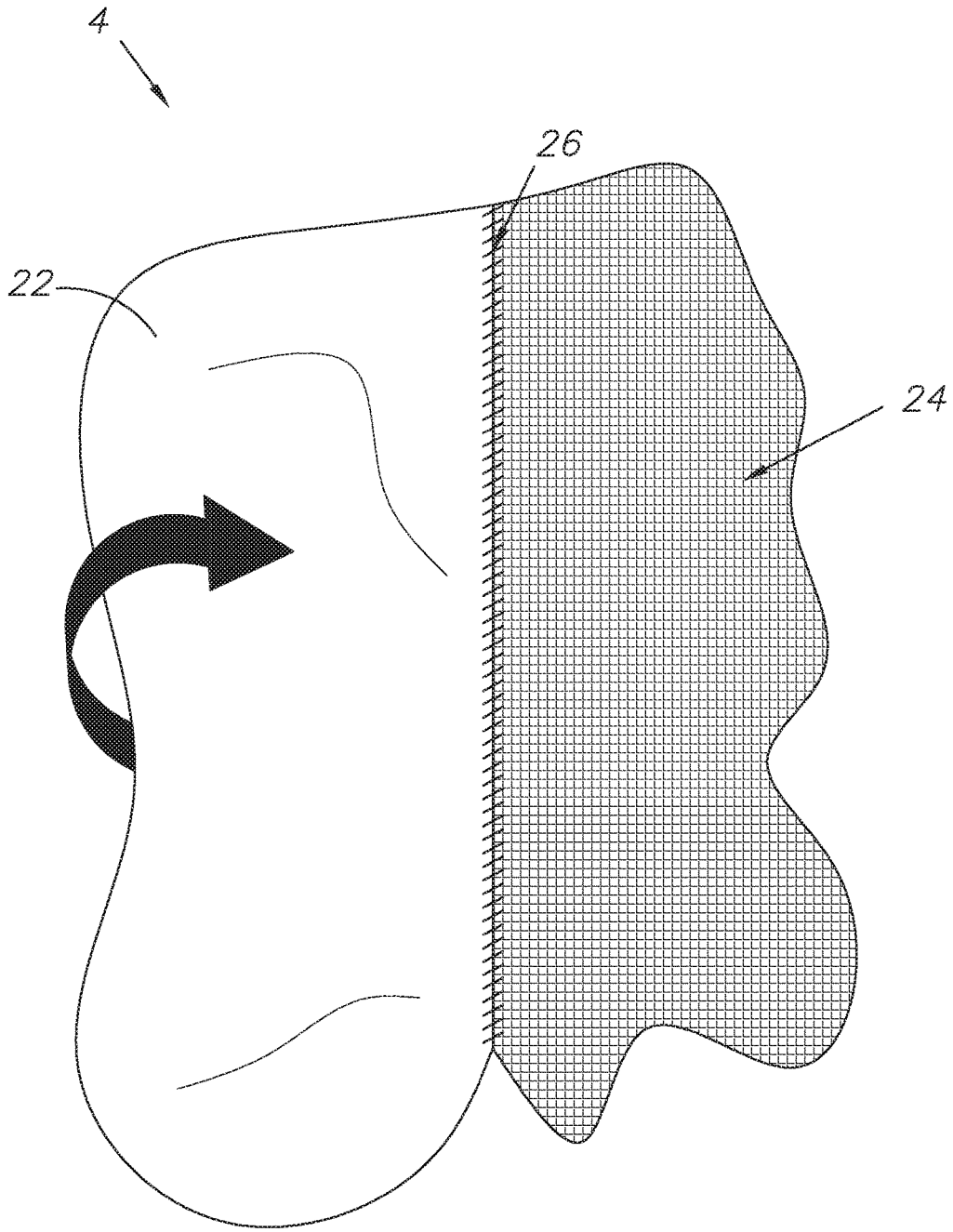
FIG. 10 is a diagrammatic representation of the mesh component and outer material component of FIG. 9 being assembled.

FIG. 9 shows a cut-away in the outer material 22 to show a forming mesh material 24 within the pocket square 4. The outer material 22 is preferably silk or some other suitable pocket square material. The inner mesh material 24 helps to hold the outer material's pre-folded shape and design. FIG. 10 shows how the mesh material 24 and outer material 22 are stitched together about a stitch line 26 or multiple stitch lines, and then folded such that the outer material is outside of the inner mesh material 24, and the entire assembly is folded into the pre-folded pocket square 4, with the mesh material 24 helping to ensure the outer material 22 remains in the pre-folded orientation and providing volume to the pocket square 4.

III. Alternative Embodiment Pocket Square System 52

Figure 11:
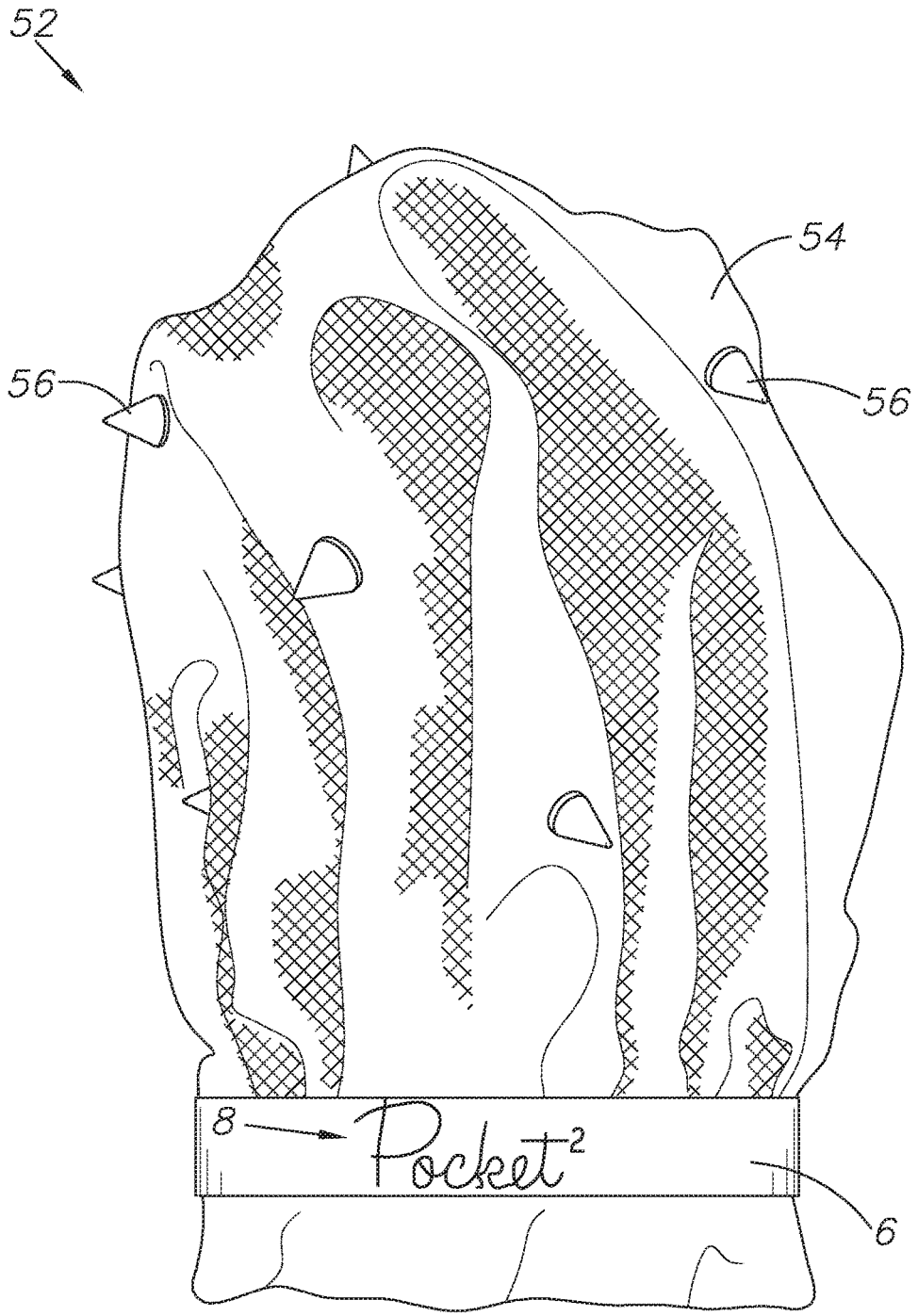
FIG. 11 is a front elevational view of an alternative embodiment of the present invention.

As shown in FIG. 11, an alternative embodiment pocket square system 52 would include the same enclosure 6 element, but would include a pocket square 54 cloth with ornamental elements 56, such as spikes or other attached ornamentation. This provides a unique pocket square design for the user. The embellishments are not limited to the ones shown in FIG. 9, but could include any ornamentation including, but not limited to, sports teams logos, standard design elements, and religious insignia.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A pocket square system comprising:

a pocket square comprising a folded cloth;

an enclosure configured to receive said pocket square, said enclosure comprising a front face, a rear face, and an interior space for housing said pocket square;

a backing plate configured to secure said enclosure to a jacket pocket;

a slip gap located within said rear face of said enclosure, said slip gap providing entry into said interior space and configured to allow said pocket square to be inserted into said interior space;

at least one magnet affixed to said rear face of said enclosure;

said backing plate containing ferromagnetic material configured to allow magnetic interface with said at least one magnet, thereby securing said enclosure to said jacket pocket;

said at least one magnet comprising a first magnet located on a first side of said slip gap and a second magnet located on a second side of said slip gap; and whereby said enclosure and backing plate constrict said pocket square and prevent unfolding of said folded cloth.

2. The system of claim 1, further comprising:

wherein said pocket square is a pre-folded pocket square; and wherein said pocket square is comprised of a material selected from the list consisting of: silk; cotton; mesh cloth; and wool.

3. The system of claim 1, further comprising:

said pocket square including a plurality of embellishments affixed to said pocket square.

4. The system of claim 3, wherein said embellishments are rounded spikes.

5. The system of claim 3, wherein said embellishments are logos.

6. The system of claim 1, further comprising:

said folded cloth comprising a combination of an interior cloth material and an exterior cloth material;

said interior cloth material comprising a mesh material configured to hold said pocket square's shape; and said exterior cloth material comprising a material selected from the list consisting of: silk; cotton; mesh cloth; and wool.

7. A method of affixing a pocket square to a suit jacket, the method comprising the steps:

providing a pre-folded pocket square comprising an interior mesh material and exterior cloth material in a pre-folded pocket square configuration;

inserting said pocket square into an enclosure comprising a front face, a rear face, and an interior space for housing said pocket square;

placing said enclosure in proximity with a pocket of a suit jacket;

securing said enclosure to said suit jacket using a backing plate;

wherein said enclosure comprising a slip gap located within said rear face of said enclosure, said slip gap providing entry into said interior space and configured to allow said pocket square to be inserted into said interior space;

securing said backing plate to said enclosure through said suit jacket via at least one magnet, whereby said backing plate comprises a ferromagnetic material; and wherein said at least one magnet comprising a first magnet located on a first side of said slip gap and a second magnet located on a second side of said slip gap.

8. The method of claim 7, further comprising the step:

affixing a plurality of embellishments to an exterior face of said pocket square.

9. The method of claim 8, wherein said embellishments are rounded spikes.

10. The method of claim 8, wherein said embellishments are logos.

* * * * *